United States Patent [19]

Luigi

[11] Patent Number: 4,697,289

[45] Date of Patent: Oct. 6, 1987

[54] PROTECTIVE DEVICE APPLICABLE TO HELMETS, ESPECIALLY FOR SPORTS USE

[75] Inventor: Nava P. Luigi, Bergamo, Italy

[73] Assignee: Nava & C. S.p.A., Verderio Superiore, Italy

[21] Appl. No.: 752,249

[22] Filed: Jul. 3, 1985

[30] Foreign Application Priority Data

Sep. 10, 1984 [IT] Italy ..... 22588A/84

[51] Int. Cl.[4] ..... A42B 3/00

[52] U.S. Cl. ..... 2/422; 2/4; 2/424; 2/205

[58] Field of Search ..... 2/422, 424, 410, 6, 2/8, 10, 205, 199, 185 R, 5, 4

[56] References Cited

U.S. PATENT DOCUMENTS

| | | | |
|---|---|---|---|
| 270,242 | 1/1883 | Mitchell | 2/199 X |
| 2,472,033 | 5/1949 | Wetzel | 2/4 |
| 3,016,545 | 1/1962 | Donahue | 2/10 X |
| 3,123,831 | 3/1964 | Wells et al. | 2/2 |
| 3,594,814 | 7/1971 | Schuessler | 2/410 |
| 3,765,031 | 10/1973 | Beresic | 2/422 X |
| 3,825,952 | 7/1974 | Pershing et al. | 2/422 |
| 4,214,318 | 7/1980 | Gomez | 2/4 |
| 4,312,076 | 1/1982 | Gamm | 2/199 |

FOREIGN PATENT DOCUMENTS

| | | | |
|---|---|---|---|
| 7626232.3 | 8/1970 | Fed. Rep. of Germany . | |
| 7226037 | 7/1972 | Fed. Rep. of Germany . | |
| 8001637 | 4/1980 | Fed. Rep. of Germany . | |
| 95070 | 6/1970 | France . | |
| 1402287 | 8/1975 | United Kingdom . | |
| 1526574 | 9/1978 | United Kingdom | 2/424 |
| 2120556 | 12/1983 | United Kingdom | 2/410 |
| 2128071 | 4/1984 | United Kingdom | 2/410 |

OTHER PUBLICATIONS

Schuberth-Werk, Patentanwalte Gramm+Lins, #3,017,099, 11-1981.

*Primary Examiner*—Peter Nerbun
*Attorney, Agent, or Firm*—Ladas & Parry

[57] ABSTRACT

A protective device can be applied movably to the lower part of helmet (A); it is provided with a folding envelope (B) fitted preferably to the rear part of the helmet and apt to contain a flexible protective screen (C) which, when extracted from the envelope can be fitted in the helmet's lower part to provide protection against weather conditions.

Protective screen (C), in its position of use, is retained on helmet (A) by means of movable securing elements (24) between the lower edge of helmet (A) and the top edge of protective screen (C) so that when the screen is not in use it may be removed from the front part of the helmet, folded and contained in envelope (B).

21 Claims, 6 Drawing Figures

PROTECTIVE DEVICE APPLICABLE TO HELMETS, ESPECIALLY FOR SPORTS USE

DESCRIPTION

This invention relates to a protective device suit able to be applied to helmets in general, in particular to sports helmets.

The usual types of helmets do not provide the complete protection required against weather conditions, especially in their lower part.

The object of this invention is to provide a complete and satisfactory protection on the bottom part of a helmet; the protection is of a type which can be easily shifted, if necessary, to meet the user's requirements and which occupies the least possible space when not in use while being also easy to remove.

A further object of the invention is to provide a protective device apt to be applied to the usual types of helmets, and apt to afford the best possible protection to the user against weather conditions and on the other hand not interfere with his work.

The device according to the invention is characterized by an at least partly flexible envelope provided with means for securing it movably to the lower part of the helmet and which houses a flexible protective screen extendable along at least part of the helmet's lower aperture to form a protection in front of said aperture.

This concept is obviously open to a number of embodiments, depending also on the characteristics of the helmet on which the device is to be applied but it is understood that any such embodiments are covered in the protective domain of the invention.

The folding envelope according to this invention can be arranged either in front or on the rear of the helmet's lower opening, while the protective shield may consist of a single element covering the helmet's lower front part.

In order to consent a rational use of the helmet to which the device according to the invention is applied, the protective screen advantageously consists of two complementary elements which may be drawn close to each other to cover the helmet's lower part and which are retained to the helmet's body by movable securing parts arranged between the lower part of the helmet and the top edge of said protective screen.

The invention will now be described, by way of example, in conjunction with the drawings which illustrate the different forms of embodiment of the screen according to the invention.

Specifically:

Figure 1:
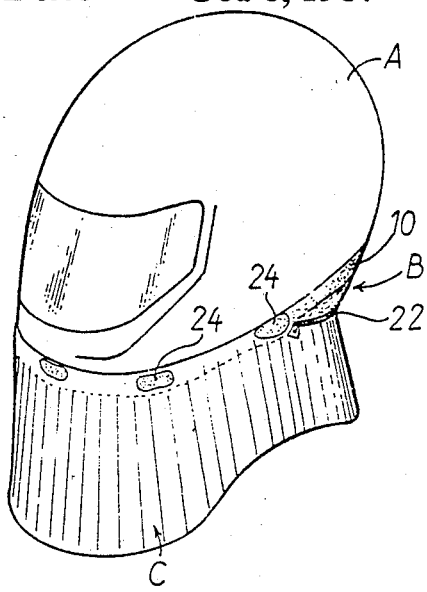
FIG. 1 is a perspective view of the helmet fitted with the device according to the invention, shown in its position of use

With reference to FIGS. 1 thru 4, letter A designates a helmet of known type provided on its bottom rear part, in the manner described infra, with an envelope (B) conveniently shaped to receive a protective screen C which can be drawn in front of the anterior part of the helmet. Specifically, as it can be seen in FIGS. 2 and 3, envelope (B) can be applied, movably to the lower front part of the helmet, being provided with an annular body 10 apt to engage with the helmet's lower edge 12 and which retains, in a convenient position, a fin 14 on the rear part of envelope wall 16, said fin being made of semi-rigid material.

To secure the device to the helmet, and ensure its correct positioning, annular body 10 is grooved so as to engage forcibly and elastically the lower edge of the helmet's body.

Envelope B extends for a certain width, to the helmet's rear part, to provide a protection for the wearer's nape.

For this purpose the envelope is provided with a padding 18 in a suitable position to form a protection for the wearer's nape and delimit in the mid rear zone a chamber apt to house, in a limited space protective screen C when suitably folded.

Figure 3:
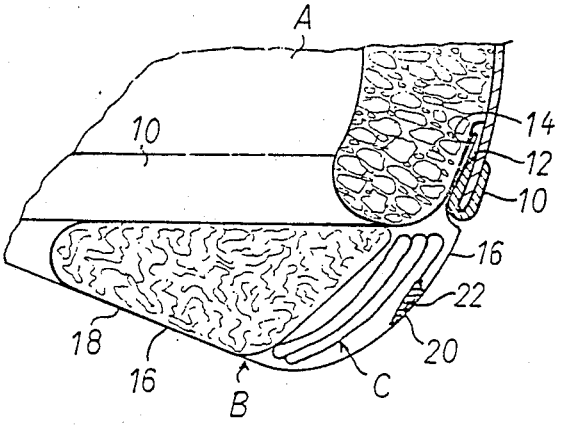
FIG. 3 is a detail, on a larger scale, showing the cross section of the device applied to the helmet.
Figure 2:
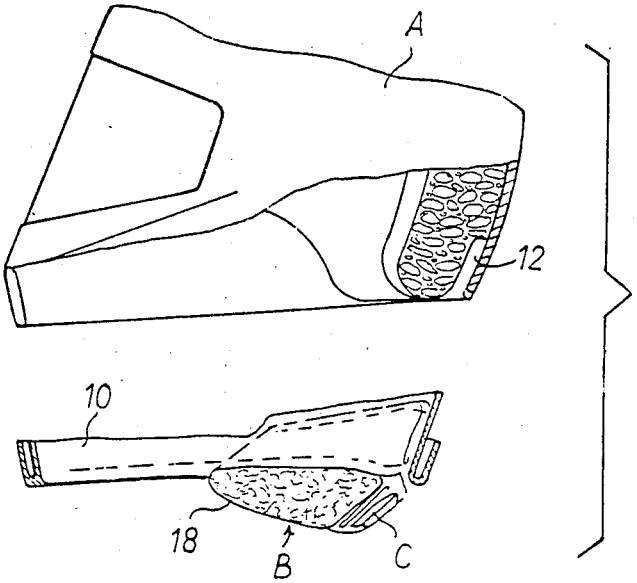
FIG. 2 is a longitudinal view, in cross section, showing the device disassembled from the helmet.
Figure 4:
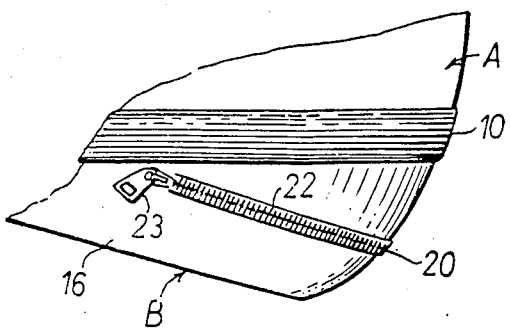
FIG. 4 is a fragmentary side view of the envelope applied to the helmet in closed position FIG. 5, similar to FIG. 1, is a side view of a variant of the device.

For this purpose, the envelope has a rear opening 20 provided with zipper 22 to permit insertion of protective screen C and which is closed by a slider 23 as shown in FIGS. 3 and 4.

Obviously, envelope B and annular body 10 are firmly secured to each other by suitable means and are applied to helmet A by forcing lower edge 12 of the helmet into the groove of annular body 10.

In this manner it is possible to remove and replace easily the device of helmet A when the latter is to be used in the usual manner.

For use, protective screen C is removed through aperture 20 by opening zipper 22 and extended over the lower part of the helmet's opening, and securing the edge of said screen to the lower part of the helmet by means of suitable movable anchorages 24 consisting of buttons, self adhesive zones or, advantageously, self engaging elements which may be connected or disconnected reciprocally.

Figure 5:
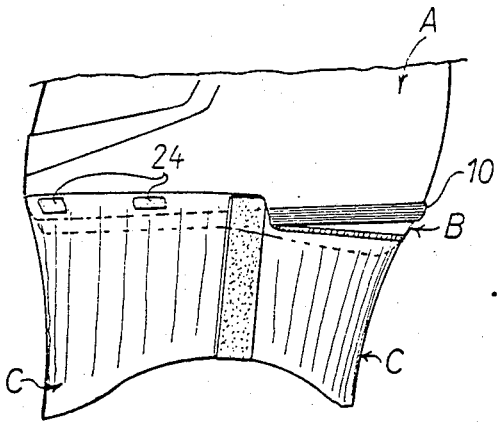
Figure 6:
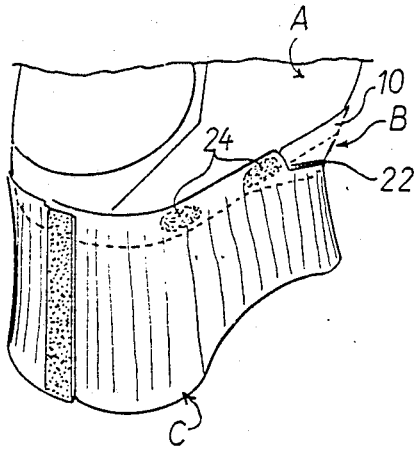
FIG. 6 is a perspective view of a further variant of the device

In the case of FIG. 1, protective screen C is of the continuous type surrounding the lower part of the helmet, while in the case of FIGS. 5 and 6, protective screen C is open laterally (FIG. 5) and in its mid part (FIG. 6). In the latter case it is possible to provide a variable opening to meet the wearer's requirements, especially as regards ventilations fo the helmet.

It is evident that in all the cases illustrated, protective screen C can be fitted on the helmet's rear by removing movable connections 24 which permit separation of the edge of said screen from the periphery of the helmet. In the case of FIGS. 5 and 6, this operation is facilitated because protective screen C consists of two elements which can be opened on their front part.

As already stated, envelope B can be conceived so as to be placed on the front part of the helmet; in this case, the movable connecting means 24 will suitably retain the edge of previously considered protective screen C, which is folded to be retained in said envelope.

Although a device according to the invention applicable to a helmet has been described, it is understood that the present protection also covers the helmet mounting the device according to the invention.

It is evident that the device described and illustrated may be modified and varied, but without departing from the domain and spirit of the invention.

What is claimed is:

1. A movable protective device for helmets, comprising an envelope (B) which is at least partly flexible, provided with means (10) for securing it movably to the lower part of a helmet (A) and which houses at extensible protective flexible screen (C) along at least part of the helmet's lower opening, to form a protection for the wearer's neck, said envelope (B) containing an opening (20) provided with closing means (22), said envelope being adapted to receive said flexible protective screen when the protective device is secured to the helmet and when the protective device is removed from the helmet wherein said flexible envelope (B) is provided, on its top part, with an appendix (14) which connects said envelope to an annular element (10) apt to engage forcibly with at least a part of the lower edge (12) of helmet (A).

2. Device according to claim 1, wherein said protective screen (C) comprises at least one flexible element, made of textile material and which covers the bottom front of the helmet.

3. Device according to claim 1, wherein said protective screen (C) comprises two complementary elements which may be brought close to each other and which are retained movably by the lower periphery of the helmet by movable securing devices fitted between the adjacent edges of helmet (A) and protective screen (C).

4. Device according to claim 1, wherein the flexible material envelope (B) is adapted to house padding material (18) in addition to the flexible protective screen (C).

5. Device according to claim 1, wherein said flexible envelope (B) is applied on the rear part of the helmet.

6. Device according to claim 5, wherein said flexible envelope (B) arranged on the rear part of the helmet, extends along the edge of said helmet with a padding (18) which affords a protection for the wearer's nape.

7. Device according to claim 1, wherein said flexible envelope (B) is arranged on the front part of the helmet.

8. A protective device, according to claim 1, wherein said screen (C) is releasably attached to the lower part of the helmet by means of anchorages (24).

9. A protective device, according to claim 8, wherein said anchorages comprise buttons.

10. A protective device, according to claim 8 wherein said anchorages comprise adhesive zones.

11. A protective device, according to claim 7, wherein said anchorages (24) retain the edge of protective screen (C) which is folded to be received by said envelope.

12. A protective device for helmets comprising an envelope (B) which is at least partly flexible and provided with an annular element (10) adapted to forcibly engage the lower edge of helmet (A) in order to removably secure said envelope to the helemt (A), said envelope (B) being adapted to house an extensible, flexible protective screen (C) when the protective device is secured to the helmet and when the protective device is removed from the helmet, said protective screen can be secured externally along the helmet's lower opening to form a protection for the wearer's neck, said envelope (B) containing an opening (20) being adapted to receive said flexible screen when the screen is not in use.

13. Device according to claim 12, wherein said protective screen (C) comprises at least one flexible element, made of textile material and which covers the bottom front of the helmet.

14. Device according to claim 12, wherein said protective screen (C) comprises two complementary elements which may be brought close to each other and which are retained movably by the lower periphery of the helmet by movable securing devices fitted between the adjacent edges of helmet (A) and protective screen (C).

15. Device according to claim 12, wherein the flexible material envelope (B) is adapted to house padding material (18) in addition to the flexible protective screen (C).

16. Device according to claim 12 wherein the envelope (B) comprises at the top of its rear part, an appendix (14) to improve the connection of said envelope (B) with said annular element (10).

17. Device according to claim 1, wherein said flexible envelope (B) is applied on the rear part of the helmet.

18. Device according to claim 17, wherein said flexible envelope (B) arranged on the rear part of the helmet, extends along the edge of said helmet with a padding (18) which affords a protection or the wearer's nape.

19. Device according claim 12, wherein said flexible envelope is arranged in the front part of the helmet.

20. Device according to claim 14 wherein said screen (C) is releasably attached to the lower part of the helmet by means of anchorages (24).

21. Device according to claim 12, wherein said opening (2) further comprises locking means (22).

* * * * *

UNITED STATES PATENT AND TRADEMARK OFFICE

CERTIFICATE OF CORRECTION

PATENT NO. : 4,697,289

DATED : October 6, 1987

INVENTOR(S) : Pier L. Nava

It is certified that error appears in the above-identified patent and that said Letters Patent is hereby corrected as shown below:

Title page, column 1, item [75] Inventor:

Delete "Nava P. Luigi" and replace therefor -- Pier L. Nava--.

Item [19] "Luigi" should read -- Nava --.

Signed and Sealed this

Second Day of August, 1988

*Attest:*

*Attesting Officer*

DONALD J. QUIGG

*Commissioner of Patents and Trademarks*